US008201920B2

(12) United States Patent
Nakamura et al.

(10) Patent No.: US 8,201,920 B2
(45) **Date of Patent: *Jun. 19, 2012**

(54) HEAD CARTRIDGE AND LIQUID EJECTION APPARATUS

(75) Inventors: Atsushi Nakamura, Kanagawa (JP); Shota Nishi, Kanagawa (JP); Masato Nakamura, Kanagawa (JP); Toshio Fukuda, Kanagawa (JP); Yuji Yakura, Kanagawa (JP); Shigeyoshi Hirashima, Kanagawa (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 1239 days.

This patent is subject to a terminal disclaimer.

(21) Appl. No.: 11/945,741

(22) Filed: Nov. 27, 2007

(65) Prior Publication Data

US 2008/0074463 A1 Mar. 27, 2008

Related U.S. Application Data

(63) Continuation of application No. 11/069,376, filed on Mar. 1, 2005, now Pat. No. 7,334,865.

(30) Foreign Application Priority Data

Mar. 3, 2004 (JP) ..... 2004-059433
Mar. 3, 2004 (JP) ..... 2004-059434

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 6,460,967 | B1 | 10/2002 | Makita et al. | |
| 6,637,856 | B2 | 10/2003 | Nishi et al. | |
| 6,975,466 | B2 | 12/2005 | Umeyama et al. | |
| 7,073,886 | B2 | 7/2006 | Nakamura | |
| 7,252,361 | B2 | 8/2007 | Nishikawa et al. | |
| 2005/0007412 | A1 * | 1/2005 | Nishikawa et al. | 347/33 |
| 2007/0247487 | A1 * | 10/2007 | Nakamura et al. | 347/33 |

FOREIGN PATENT DOCUMENTS

| | | |
|---|---|---|
| JP | 06-255117 | 9/1994 |
| JP | 10-044447 | 2/1998 |

OTHER PUBLICATIONS

Japanese Office Action issued on Jun. 5, 2007.

* cited by examiner

*Primary Examiner* — Matthew Luu
*Assistant Examiner* — Alejandro Valencia
(74) *Attorney, Agent, or Firm* — SNR Denton US LLP

(57) ABSTRACT

A head cartridge and a liquid ejection apparatus in which cleaning is performed using a liquid absorbing force of a wiping member produced along with restoration of temporarily increased elastic displacement of the wiping member.

12 Claims, 10 Drawing Sheets

HEAD CARTRIDGE AND LIQUID EJECTION APPARATUS

RELATED APPLICATION DATA

This application is a continuation of U.S. patent application Ser. No. 11/069,376, filed Mar. 1, 2005, the entirety of which is incorporated herein by reference to the extent permitted by law. The present application also claims priority to Japanese Patent Application Nos. 2004-059433 filed in the Japanese Patent Office on Mar. 3, 2004 and 2004-059434 filed in the Japanese Patent Office on Mar. 3, 2004, the entirety both of which also are incorporated by reference herein to the extent permitted by law.

BACKGROUND OF THE INVENTION

1. Field of the Invention

The present invention relates to a head cartridge for ejecting predetermined liquid onto an ejection object and a liquid ejection apparatus.

2. Description of the Related Art

Hitherto, in such a liquid ejection apparatus, an inkjet printer for example, a cleaning roller formed of a cylindrical porous material has been continuously maintained in contact with a nozzle surface of an ink ejection head of a head cartridge under a predetermined pressure so as to relatively move, so that stains or foreign bodies are removed by absorbing ink within an ink ejection nozzle and its vicinity using the capillarity produced in a cell (pore cell) of the porous material (see Japanese Unexamined Patent Application Publication No. 2003-266717, P5, FIGS. 6 to 8, for example).

However, in such a head cartridge in related art, ink is naturally absorbed into the cleaning roller by moving and continuously bringing the cleaning roller in contact with the nozzle surface under a predetermined pressure so as to use the capillarity produced in the cell of the porous material, so that ink is removed with no positive approach. Accordingly, ink stuck into the ink ejection nozzle or its vicinity so as to thicken may not be sufficiently removed because of the weak capillarity.

SUMMARY OF THE INVENTION

Accordingly, in view of such problems, it is desirable that the present invention provide a head cartridge and a liquid ejection apparatus having a cleaner with a capacity improved using a sweeping member with a sucking force produced by temporarily increasing its elastic displacement so as to restore the displacement.

According to an embodiment of the present invention, there is provided a head cartridge including a liquid ejection head for ejecting predetermined liquid from a plurality of liquid ejection nozzles formed on a nozzle surface; cleaning means for cleaning the nozzle surface of the liquid ejection head by relatively moving a porous wiping member so as to bring the wiping member into contact with the nozzle surface with elastic deformation of the wiping member; and deforming means for temporarily increasing the elastic deformation of the wiping member at a position in the foreground of the liquid ejection nozzles in the cleaning direction, wherein liquid stuck on the nozzle surface is absorbed and removed by an absorbing force produced along with restoring operation of the elastic deformation of the wiping member.

By such a structure, the elastic deformation of the wiping member of the cleaning means for cleaning the nozzle surface of the liquid ejection head by relatively moving a porous wiping member so as to bring the wiping member into contact with the nozzle surface is temporarily increased by the deforming means at a position in the foreground of the liquid ejection nozzles in the cleaning direction. By the absorbing force produced along with the restoring operation of the elastic deformation, predetermined liquid stuck to the nozzle surface is absorbed and removed with the wiping member. Accordingly, to the capillarity ordinarily produced in the pressure contact part of the wiping member made of a porous member, the absorbing force produced along with the restoring operation of the elastic deformation is added so as to increase the absorbing force of liquid, improving the cleaning performance of the cleaning means.

A liquid ejection apparatus according to the present invention includes a head cartridge that includes a liquid ejection head for ejecting predetermined liquid from a plurality of liquid ejection nozzles formed on a nozzle surface; cleaning means for cleaning the nozzle surface of the liquid ejection head by relatively moving a porous wiping member so as to bring the wiping member into contact with the nozzle surface with elastic deformation of the wiping member; and deforming means for temporarily increasing the elastic deformation of the wiping member at a position in the foreground of the liquid ejection nozzles in the cleaning direction, wherein liquid stuck on the nozzle surface is absorbed and removed by an absorbing force produced along with restoring operation of the elastic deformation of the wiping member.

By such a structure, the elastic displacement of the wiping member of the cleaning means for cleaning the nozzle surface of the liquid ejection head by relatively moving a porous wiping member so as to bring the wiping member into contact with the nozzle surface is temporarily increased by the deforming means at a position in the foreground of the liquid ejection nozzles in the cleaning direction, so that predetermined liquid stuck to the nozzle surface is absorbed and removed with the wiping member. Thereby, to the capillarity ordinarily produced in the pressure contact part of the wiping member made of a porous member, the absorbing force produced along with the restoring operation of the elastic deformation is added, improving the cleaning performance of the cleaning means.

According to the embodiment of the present invention, there is provided a head cartridge including a liquid ejection head for ejecting predetermined liquid from a plurality of liquid ejection nozzles formed on a nozzle surface; cleaning means for cleaning the nozzle surface of the liquid ejection head by relatively moving a porous wiping member so as to bring the wiping member into contact with the nozzle surface with elastic deformation of the wiping member; and deforming means for temporarily increasing the elastic deformation of the wiping member at a position in the foreground of the liquid ejection nozzles in the cleaning direction, wherein an elastic displacement h of the wiping member produced by the deforming means is established to satisfy the following condition:

$$h>(Vu/Vr)(L+n/2-\phi/2),$$

where the restoring speed of the elastic deformation of the wiping member is denoted as Vu; the moving speed of the wiping member is denoted as Vr; the movement distance of the wiping member from a restoring initiation point of the elastic deformation to the center of the liquid ejection nozzles is L; the contact width between the wiping member and the nozzle surface is n; and the diameter of the liquid ejection nozzle is $\phi$.

By such a structure, during the cleaning operation of the nozzle surface performed by relatively moving a porous wiping member so as to bring the wiping member into contact with the nozzle surface with elastic deformation of the wiping member, the elastic displacement produced in the wiping member by the deforming member at a position in the foreground of the liquid ejection nozzles in the cleaning direction is temporarily increased by the displacement h so as to maintain the restoring operation of the elastic deformation of the wiping member until the wiping member passes through the liquid ejection nozzles. Thereby, using the absorbing force produced along with the restoring operation of the temporarily increased elastic deformation, liquid stuck into the ink ejection nozzle or its vicinity so as to thicken is absorbed and removed.

A liquid ejection apparatus according to the present invention includes a head cartridge that includes a liquid ejection head for ejecting predetermined liquid from a plurality of liquid ejection nozzles formed on a nozzle surface; cleaning means for cleaning the nozzle surface of the liquid ejection head by relatively moving a porous wiping member so as to bring the wiping member into contact with the nozzle surface with elastic deformation of the wiping member; and deforming means for temporarily increasing the elastic deformation of the wiping member at a position in the foreground of the liquid ejection nozzles in the cleaning direction, wherein an elastic displacement h of the wiping member produced by the deforming means is established to satisfy the following condition:

$$h>(Vu/Vr)(L+n/2-\phi/2),$$

where the restoring speed of the elastic deformation of the wiping member is denoted as Vu; the moving speed of the wiping member is denoted as Vr; the movement distance of the wiping member from a restoring initiation point of the elastic deformation to the center of the liquid ejection nozzles is L; the contact width between the wiping member and the nozzle surface is n; and the diameter of the liquid ejection nozzle is $\phi$.

By such a structure, during the cleaning operation of the nozzle surface performed by relatively moving and pressurizing a porous wiping member included in the head cartridge with elastic deformation of the wiping member, the elastic displacement produced in the wiping member by the deforming member at a position in the foreground of the liquid ejection nozzles in the cleaning direction is temporarily increased by the displacement h so as to maintain the restoring operation of the elastic deformation of the wiping member until the wiping member passes through the liquid ejection nozzles. Thereby, using the absorbing force produced along with the restoring operation of the temporarily increased elastic deformation, liquid stuck into the ink ejection nozzle or its vicinity so as to thicken is absorbed and removed.

DESCRIPTION OF THE PREFERRED EMBODIMENTS

Figure 1:
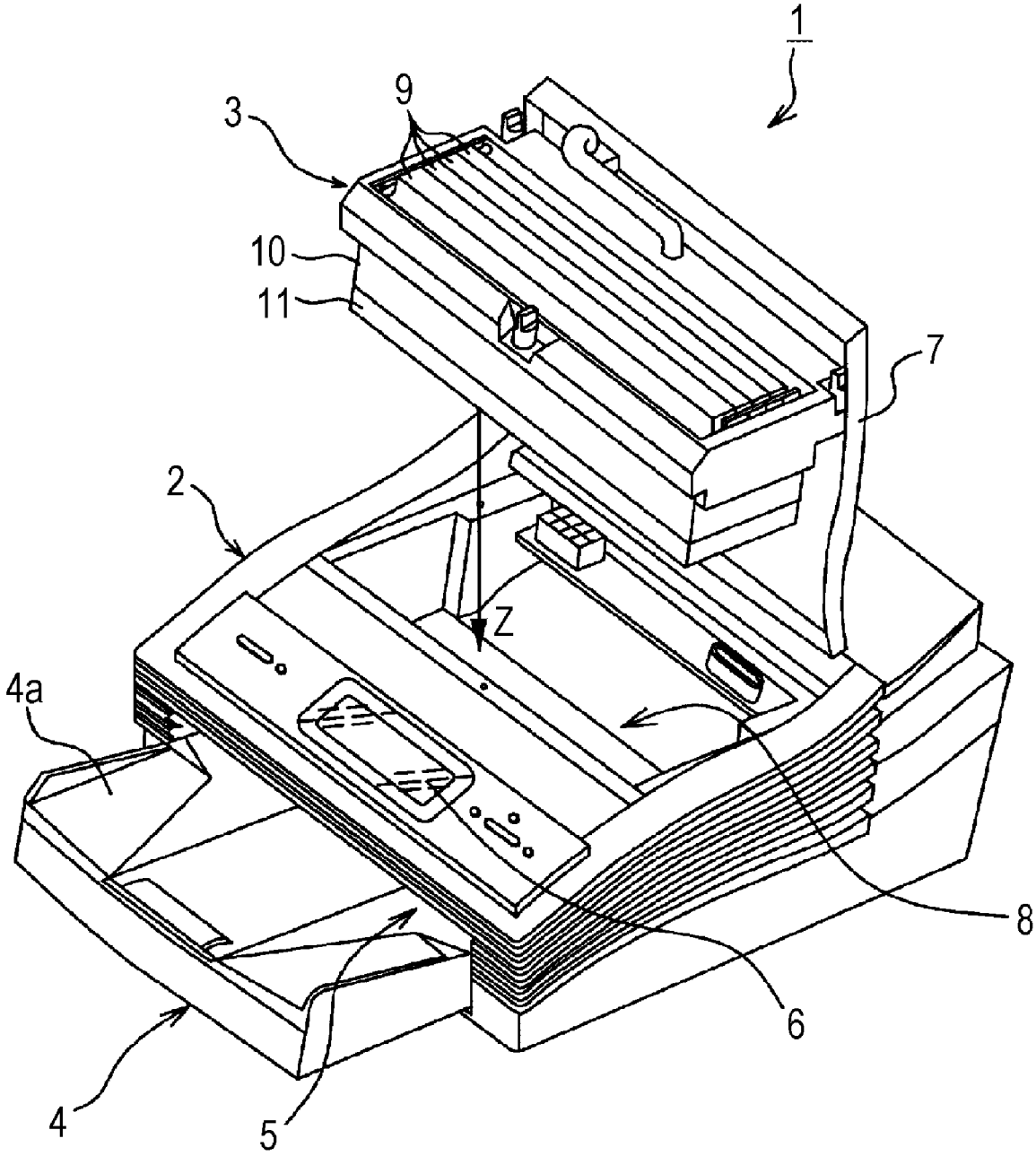
FIG. 1 is a perspective view of an inkjet printer according to an embodiment of the present invention.

Embodiments of the present invention will be described below in detail with reference to the attached drawings. FIG. 1 is a perspective view of an inkjet printer, an exemplified liquid ejection apparatus according to the present invention. An inkjet printer 1 includes a printer body 2 and a head cartridge 3 (see FIG. 2) for ejecting ink droplets on a recording sheet so as to form images thereon.

The printer body 2 shown in FIG. 1 includes a conveying mechanism (not shown) for conveying a recording sheet accommodated within a recording sheet tray 4 as an object for ejection and a controller (not shown) for suitably controlling to form images on the recording sheet, which are accommodated within the printer body 2. The recording sheet tray 4 is detachably mounted on a tray loading slot 5 provided in the lower front of the printer body 2. The tray loading slot 5 also serves as a discharge slot for a recording sheet so that a recording sheet having images recorded thereon in the printer body 2 is to be discharged on a discharge sheet receiver 4*a* provided on the recording sheet tray 4. The printer body 2 is also provided with a display panel 6 arranged in the upper front of the body for displaying entire operations of the inkjet printer 1.

On the upper surface of the printer body 2, an open/close upper lid 7 is attached. Under the upper lid 7, there is provided a holder 8 arranged on the upper portion of the printer body 2 for accommodating the head cartridge 3. In the holder 8 of the printer body 2, the head cartridge 3 is inserted in arrow Z direction and detachably accommodated therein. The head cartridge 3 has a casing slenderize extending in the width direction of the printer body 2, i.e., the width direction of a recording sheet, for ejecting four color inks of yellow Y, magenta M, cyan C, and black K on a recording sheet for forming images. The head cartridge 3 includes an ink tank 9, a print head 10, and a head cap 11.

Then, a first embodiment of the present invention of the head cartridge suitable for the inkjet printer will be described with reference to FIGS. 2 to 6.

Figure 2:
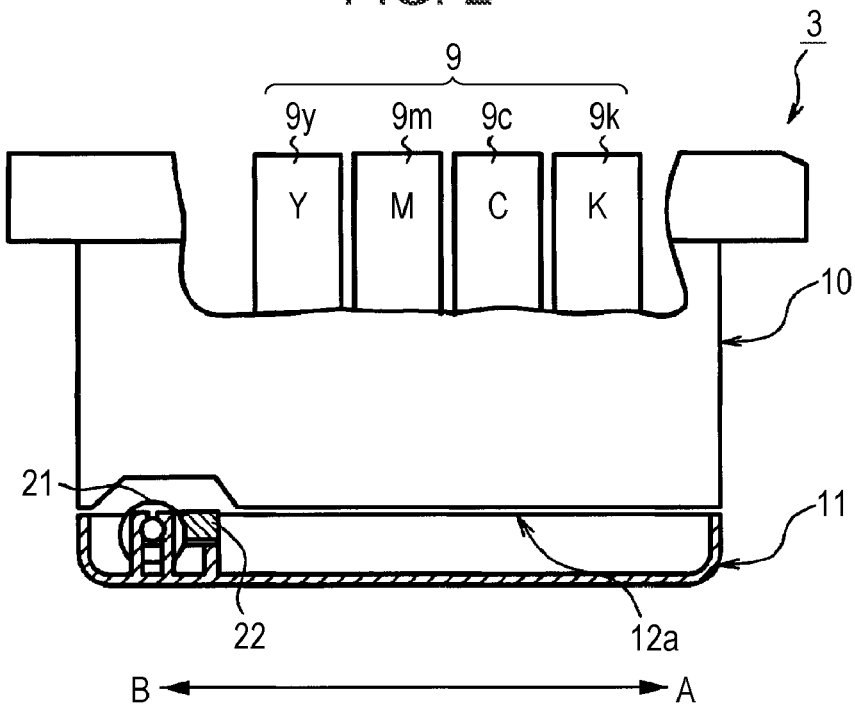
FIG. 2 is a side view of a schematic structure of a head cartridge according to a first embodiment of the present invention.
Figure 3:
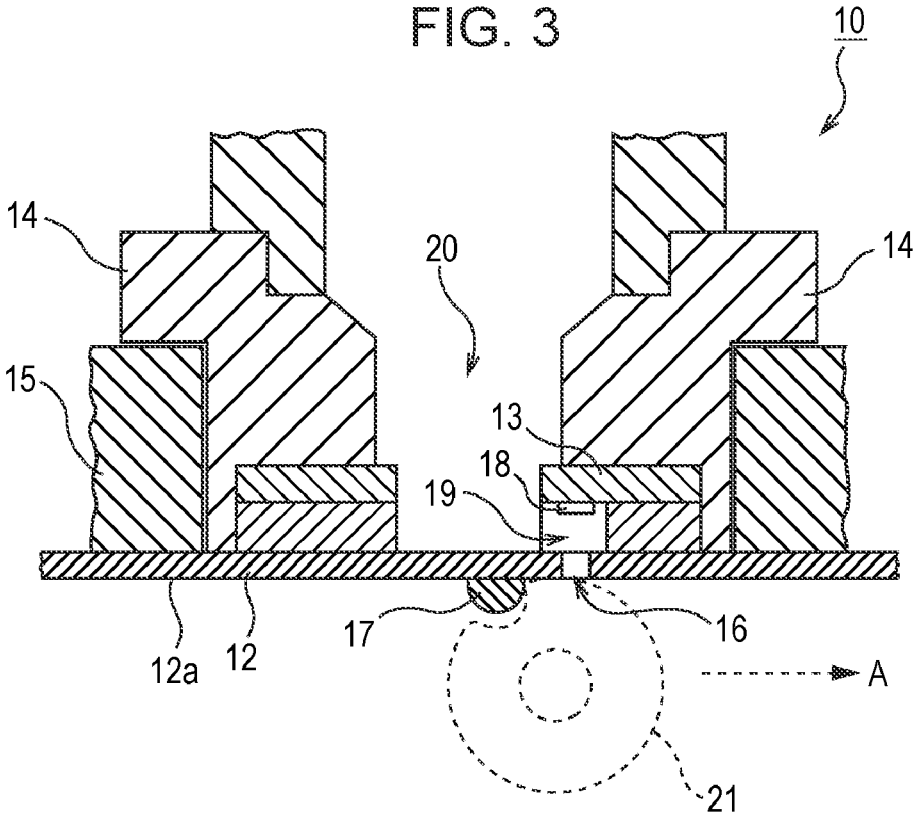
FIG. 3 is an enlarged sectional view of an essential part of a printer head.

FIG. 2 is a partially sectional side view of the head cartridge 3 shown in FIG. 1. Four ink tanks 9 (9*y*, 9*m*, 9*c*, and 9*k*) are loaded within the head cartridge 3. The ink tank 9 is a liquid container for storing ink, so that the respective ink tanks 9 contain the four color inks of Y, M, C, and K. The ink tank 9 supplies ink contained therein into the print head 10. The print head 10 is referred to as a full-line print head for ejecting ink supplied from the ink tank 9 over the entire width of a recording sheet, and as shown in FIG. 3, it includes a nozzle member 12, a head chip 13, a flow channel plate 14, and a head frame 15.

On the bottom surface of the print head 10, the nozzle member 12 including a nozzle surface 12*a* is arranged. The nozzle member 12 is provided with a line of ink ejection nozzles 16 arranged so that its longitudinal direction corresponds to the entire width of a recording sheet. Furthermore, the nozzle surface 12*a* is provided with a projection 17 arranged in the foreground of the ink ejection nozzles 16 in the cleaning direction of a cleaning roller 21 (arrow A direction in FIG. 3) during cleaning the nozzle surface 12*a* with the cleaning roller 21 (below mentioned). The projection 17 temporarily increases an elastic displacement of the cleaning roller 21 so that ink stuck to the nozzle surface 12*a* is absorbed in the cleaning roller 21 by a sucking force produced according to the restoration of the elastic deformation. The projection 17 may be formed by applying a UV curable resin to the ink ejection nozzle 16 in parallel with the alignment direction of the ink ejection nozzles 16 with a dispenser so as to be cured by irradiating the ink ejection nozzles 16 with a UV ray. In this case, the cross section of the projection 17 becomes substantially semicircular due to a surface tension of the resin. A height H of the projection 17 is established to have a displacement enough to maintain the restoration of the elastic deformation until that the cleaning roller 21 passes through the ink ejection nozzles 16.

Figure 4:
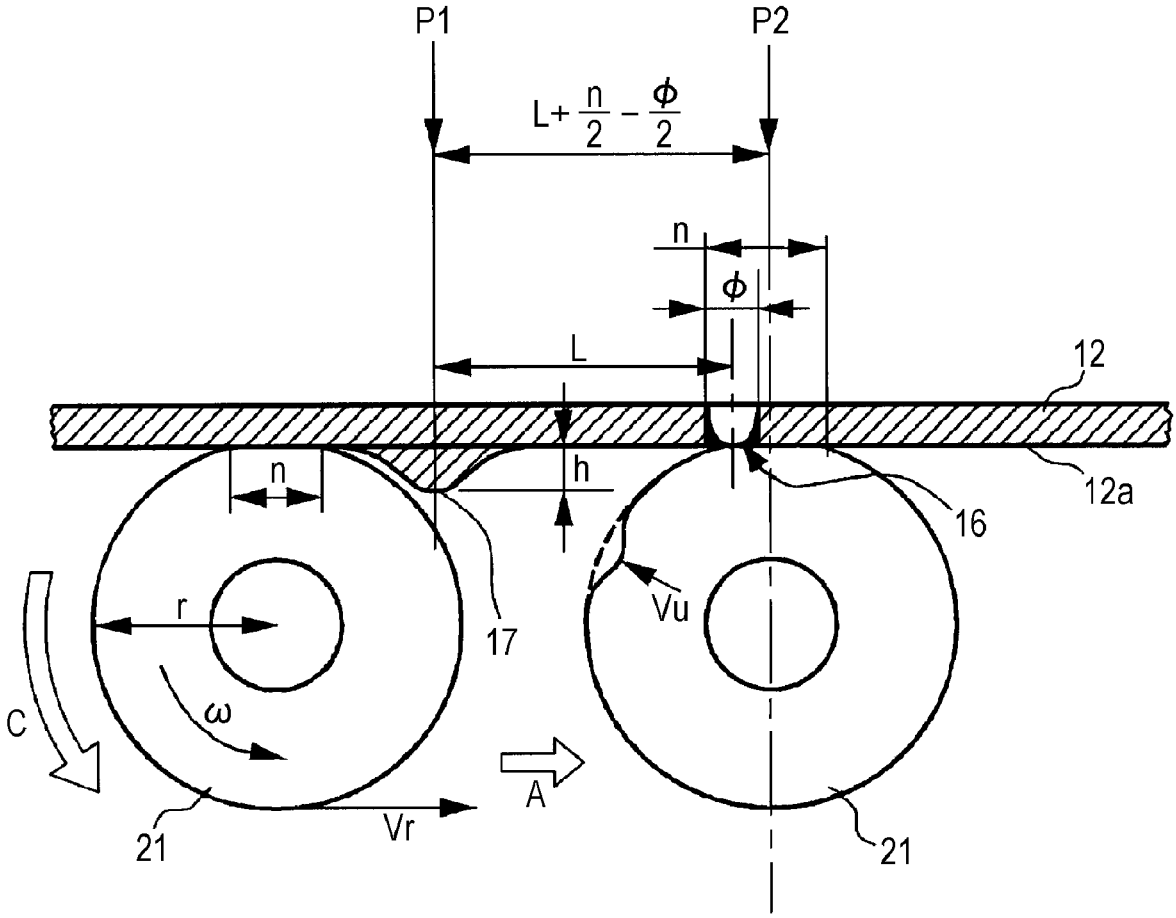
FIG. 4 is an explanatory view illustrating the derivation of a conditional equation for establishing the height of a projection.

Specifically, a height h of the projection 17 is established to satisfy the following condition (1):

$$h>(Vu/Vr)(L+n/2-\phi/2) \quad (1),$$

where as shown in FIG. 4, the restoring speed of the elastic deformation applied to the cleaning roller 21 is denoted as Vu; the moving speed of the cleaning roller 21 is denoted as Vr; the horizontal distance from a restoring initiation point (sucking initiation point) P1 of the elastic deformation to the nozzle center of the ink ejection nozzles 16 is L; the contact width (nip width) between the cleaning roller 21 and the nozzle surface 12*a* is n; and the diameter of the ink ejection nozzle 16 is $\phi$. In this case, $n>\phi$. The height h of the projection 17 substantially agrees on the elastic displacement (temporarily increased elastic displacement) of the cleaning roller 21 caused by the projection 17, and corresponds to the depth of the elastic deformation. In addition, the height h of the projection 17 is established herein; alternatively, any other parameter may be established to satisfy the condition (1).

The derivation of the condition (1) will be described in detail.

Figure 5:
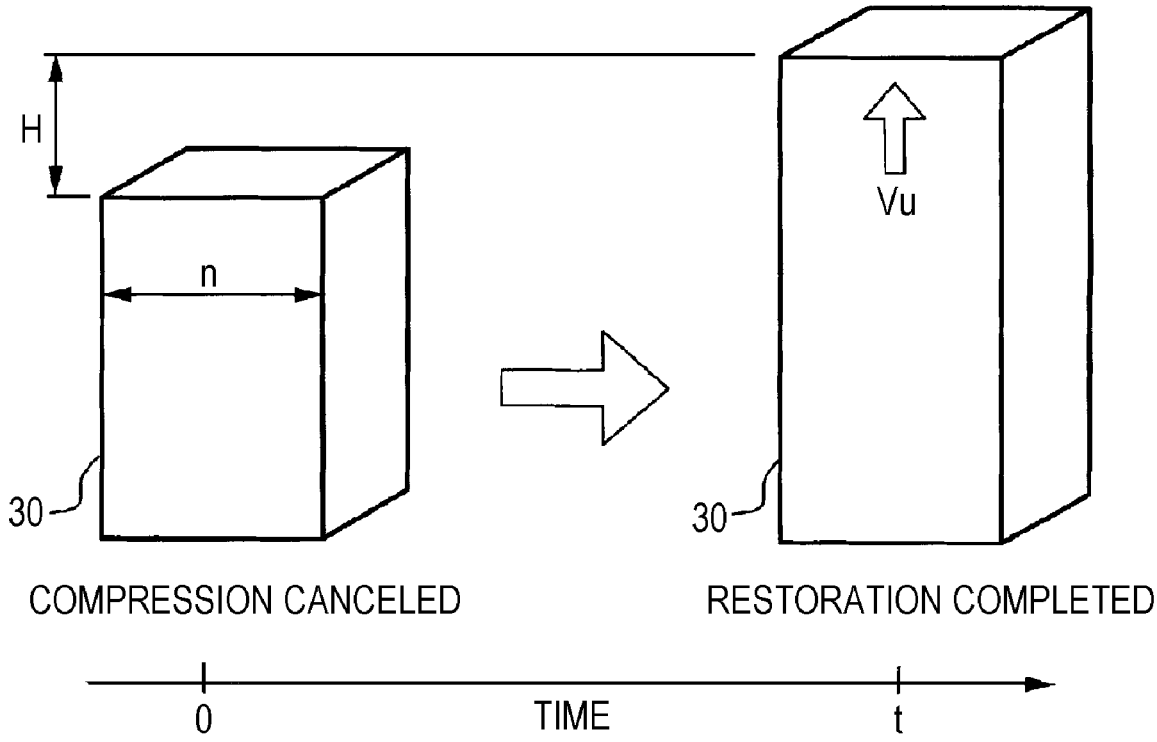
FIG. 5 is an explanatory view illustrating the measurement of a restoring speed of the shape of a cleaning roller.

As described above, since the height h of the projection 17 substantially agrees on the elastic displacement of the cleaning roller 21 increased by the pressurizing with the projection 17, a time Tu necessary for restoring the original shape of the cleaning roller 21 elastically deformed by the pressurizing of the projection 17 is expressed by:

$$Tu=h/Vu \quad (2),$$

where character Vu denotes the restoring speed of the elastic deformation. As the restoring speed Vu is the restoration of the elastic deformation per unit time, it can be easily obtained using a cut sample with the same quality as that of the cleaning roller 21. That is, as shown in FIG. 5, upon measuring a time t to restore the original shape of a cut sample 30 with the same width as the nip width n from the compression cancellation after a compression deformation H is applied, the restoring speed Vu is obtained as:

$$Vu=H/t.$$

In order to apply to the ink ejection nozzle 16 a sucking force produced during the restoration of the cleaning roller 21 elastically deformed by the pressurizing with the projection 17, within the time Tu, the cleaning roller 21 may pass through the ink ejection nozzles 16. Hence, a time Tr necessary for the cleaning roller 21 to move from the restoring initiation point (sucking initiation point) P1 shown in FIG. 4 to a point P2 passing through the ink ejection nozzle may satisfy the following condition:

$$Tu>Tr \quad (3).$$

The value Tr herein can be obtained from the following equation:

$$Tr=(L+n/2-\varphi/2)/r\omega \quad (4)$$
$$=(L+n/2-\varphi/2)/Vr,$$

where the radius of the cleaning roller 21 is r and the angular velocity of the cleaning roller 21 is $\omega$, as shown in FIG. 4. Accordingly, by substituting the equations (2) and (4) into the equation (3) so as to rearrange the equation, the equation (1) is derived.

Also, on the upper surface of the nozzle member 12, as shown in FIG. 3, the head chip 13 is arranged. The head chip 13, including a logic circuit (not shown) controlling ink ejection based on an imaging signal and a transistor for driving a heating resistor 18 (below-mentioned), is provided with the heating resistor 18 opposing the ink ejection nozzle 16 so as to apply ejection energy to ink within an ink pressurized chamber 19 directly provided to the ink ejection nozzle 16 by the heat produced in the heating resistor 18 so as to eject ink from the ink ejection nozzle 16.

Furthermore, on the upper surface of the head chip 13, the flow channel plate 14 is provided so as to constitute an ink flow channel 20 for supplying ink to the ink pressurized chamber 19 from the ink tank 9. Although the flow channel plates 14 are shown separated in the lateral direction in FIG. 3, in fact, they are connected together to have an integral structure. On both sides of the flow channel plate 14, head frames 15 are erected on the nozzle member 12 for supporting the nozzle member 12.

On the bottom surface of the print head 10, as shown in FIG. 2, the head cap 11 is detachably mounted. The head cap 11 is moved relatively to the print head 10 so as to protect the nozzle surface 12*a* of the print head 10 in a mounted state, as well as it includes a cleaning unit for cleaning the nozzle surface 12*a*. Specifically, as shown in FIG. 6, the head cap 11 is constructed to be a hard-resin slender box with rising pieces at four corners, and it includes the cleaning roller 21 and a scraper 22, which are arranged inside, and an ink receiving member 23 laid on the bottom surface.

Figure 6:
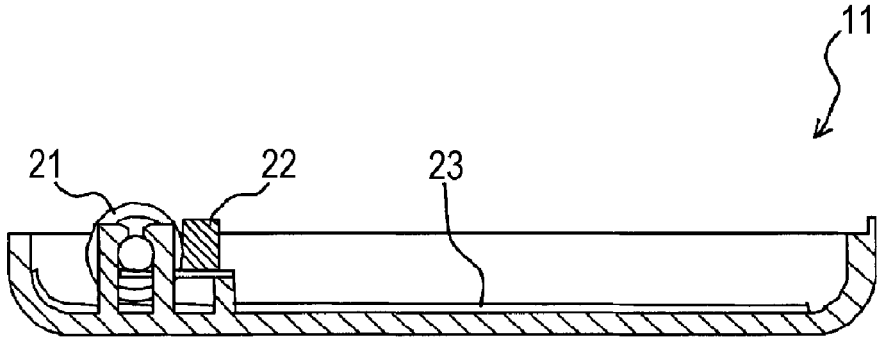
FIG. 6 is a sectional view of a structure of cleaning means.

The cleaning roller 21 shown in FIGS. 2 and 6 serves as a wiping member wiping ink sludge and dust during moving and pressing into contact with the nozzle surface 12*a* of the print head 10, as well as it includes an applying unit for applying a detergent on the nozzle surface 12*a* of the print head 10. The cylindrical cleaning roller 21 is attached adjacent on one side of the head cap 11 in the longitudinal direction of the head cap 11 so as to be parallel to the longitudinal direction of the nozzle surface 12*a* of the print head 10. The cleaning roller 21 is made of an elastic porous material including pores 21*a* (see FIG. 7B) for absorbing liquid, such as sponge and felt, and it has detergent solution impregnated therein.

As shown in FIGS. 2 and 6, a scraper 22 is arranged at a position touching one external side surface of the cleaning roller 21. The scraper 22 is a member for scraping ink sludge and dust away from the surface of the cleaning roller 21. An ink receiving member 23 shown in FIG. 6, made of a hygroscopic material such as sponge, is a member for receiving ink droplets preliminarily discharged from the ink ejection nozzle 16 of the print head 10 with the entire bottom surface of the head cap 11. Thereby, the ink receiving member 23 prevents the ink preliminarily discharged from the ink ejection nozzle 16 from spattering back as well as it can absorb ink, preventing the ink from accumulating on the bottom surface of the head. Accordingly, the preliminarily discharged ink is prevented from re-adhering onto the nozzle surface 12*a* as a result of being spattered back.

The head cap 11 constructed in such a manner, as shown in FIG. 2, is moved in directions perpendicular to the longitudinal direction of the nozzle surface 12*a*, or directions of arrows A and B. In a state that the head cap 11 moves in arrow A direction, it is removed from the print head 10, and upon returning in arrow B direction, the head cap 11 is mounted again on the print head 10 so as to protect the nozzle surface 12*a*. Then, the cleaning roller 21 cleans the nozzle surface 12*a* of the print head 10 along with the opening of the head cap 11 (moving in arrow A direction in the drawing). After a lapse of appropriate period of service, the ink receiving member 23 having the preliminarily discharged ink absorbed therein is replaced by a new ink receiving member 23, enabling the cleaning of the ink preliminarily discharged in the head cap 11 to be simply performed.

Next, the cleaning operation of the head cartridge according to the first embodiment will be described with reference to FIGS. 7A to 9.

First, referring to FIG. 1, the head cartridge 3 is fixedly accommodated in the holder 8 of the printer body 2 in arrow Z direction. The recording sheet tray 4 is further accommodated in the tray loading slot 5. In this state, before printing initiation, the nozzle surface 12*a* of the print head 10 is cleaned along with the opening of the head cap 11. This cleaning operation is performed by pressurizing the cleaning roller 21 in contact with the nozzle surface 12*a* along with the movement of the head cap 11 shown in FIG. 2 in arrow A direction in the drawing. At this time, the cleaning roller 21 moves in arrow A direction while rotating in arrow C direction in FIG. 7A. Since the cleaning roller 21 is made of a porous material, when the cleaning roller 21 is pressurized in contact with the nozzle surface 12*a*, as shown in FIG. 7B, the pores 21*a* of the portion pressurized with the cleaning roller 21 are crushed and reduced in size so as to produce a capillarity Qn in arrow D direction in the drawing larger than that of other portions. Then, the ink 24 adhered on the nozzle surface 12*a* is liable to be infiltrated into the pores 21*a*. Since in a portion in that the pressurizing is canceled along with the rolling of the cleaning roller 21, the elastic deformation is simultaneously restored so that the crushed pores 21*a* are to return to the original state, an absorbing force Qr in arrow E direction is produced in the portion. Thereby, the sum (Qn+Qr) of the capillarity Qn and the absorption force Qr is applied on the nozzle surface 12*a* so as to absorb and remove the ink 24 adhered on the nozzle surface 12*a* with the cleaning roller 21. In addition, the capillarity Qn and the absorption force Qr are the same as the absorption source produced in the cleaning roller 21 during ordinary cleaning operation in that the cleaning roller 21 moves while pressing onto the nozzle surface 12*a* under a predetermined pressure.

Figure 7A:
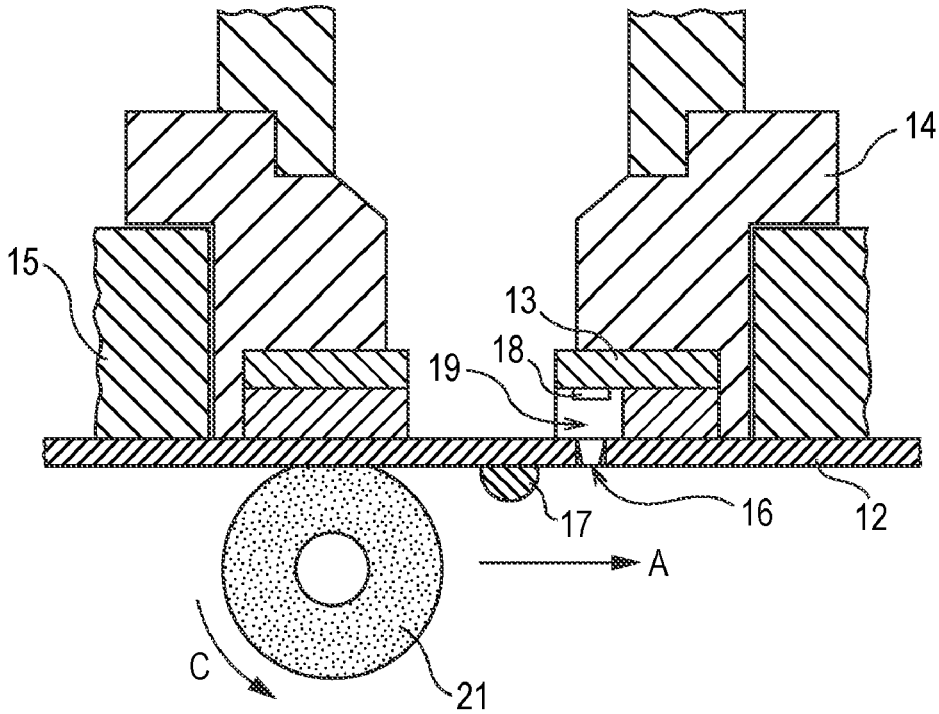
FIGS. 7A and 7B are explanatory views illustrating cleaning operation of the head cartridge.
Figure 7B:
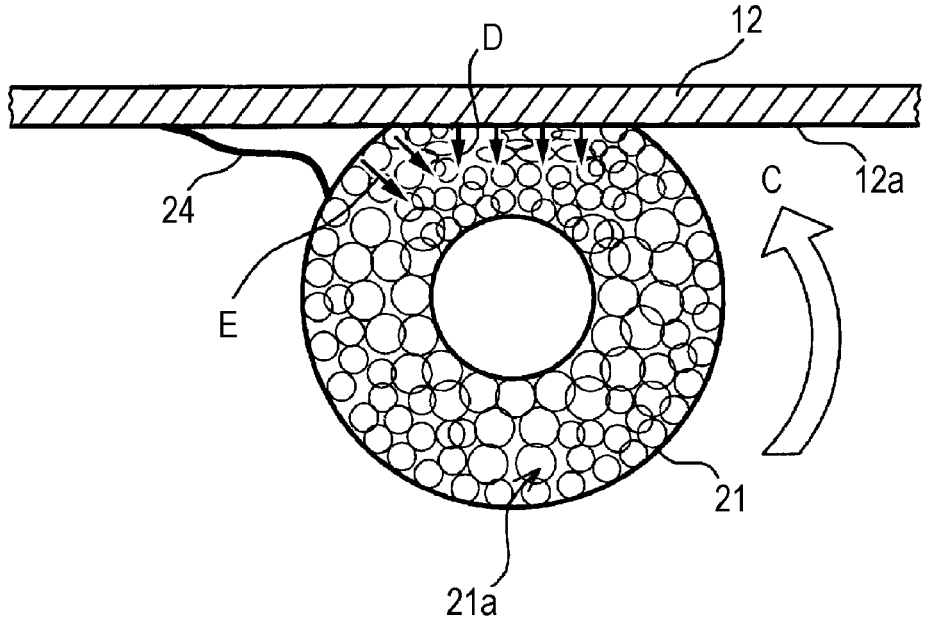
Figure 8:
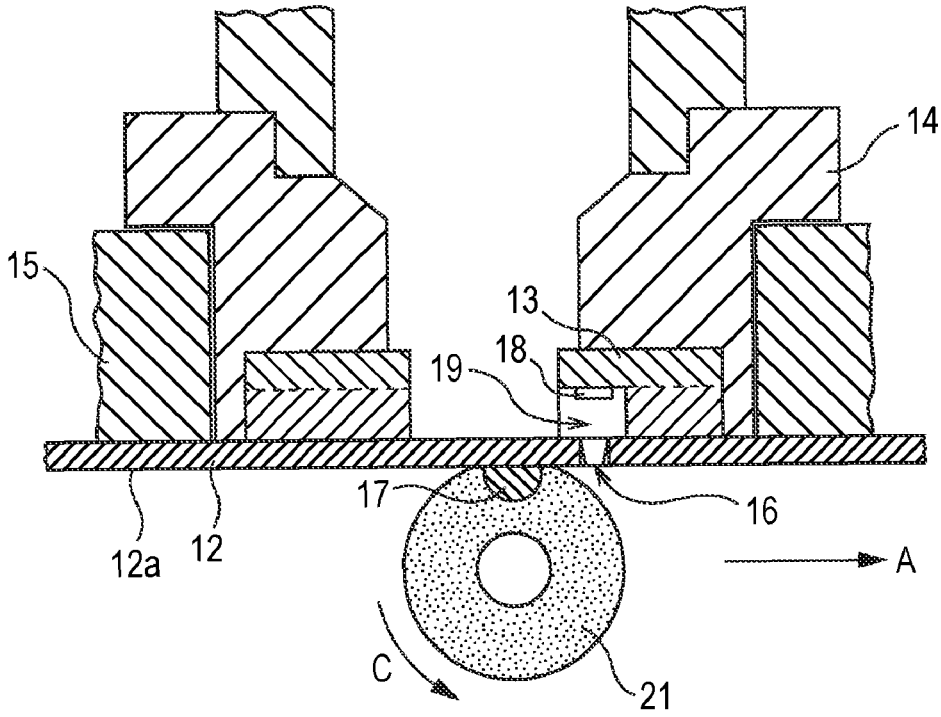
FIG. 8 is an explanatory view illustrating a state that the cleaning roller reaches a projection in the cleaning operation of the head cartridge.

Furthermore, when the cleaning roller 21 is rotated in arrow A direction in FIG. 7A so as to reach the projection 17 provided at a position in the foreground of the ink ejection nozzles 16 in arrow A direction as shown in FIG. 8, the cleaning roller 21 is pressurized by the projection 17 so that the surface of the cleaning roller 21 elastically caves in.

Figure 9:
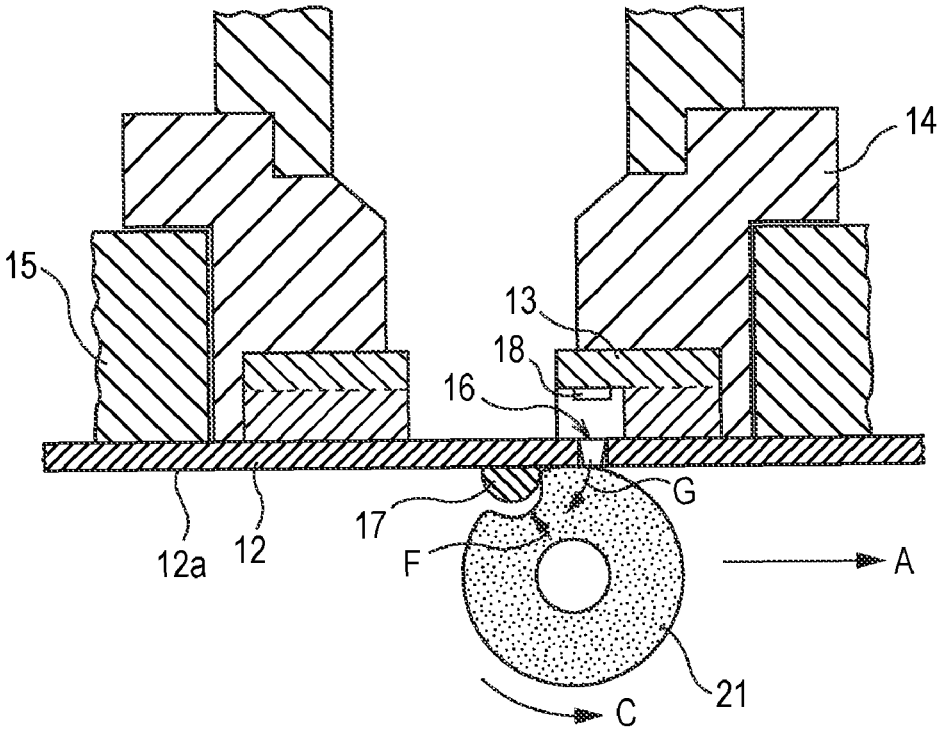
FIG. 9 is an explanatory view illustrating a state that the cleaning roller climbs over the projection in the cleaning operation of the head cartridge.

The cleaning roller 21 climbs over the projection 17 and further rolls in arrow A direction in FIG. 8. At this time, the pressurizing of the cleaning roller portion elastically deformed by the pressurizing with the projection 17 is canceled so as to restore the original shape. By such a restoring operation of the elastic deformation of the cleaning roller 21, an outward absorbing force in arrow F direction in FIG. 9 is produced in the cleaning roller 21 in a manner similar to pumping operation. Simultaneously, an absorbing force Qt with substantially the same strength is also produced in the pressure part of the cleaning roller 21 in arrow G direction in the drawing. Thereby, the sum of the capillarity Qn, the absorption force Qr, and the absorbing force Qt of the pumping operation becomes the absorbing force (Qn+Qr+Qt) so that the force is increased by the absorbing force Qt.

Since the height h of the projection 17 (or the temporarily increased elastic displacement of the cleaning roller 21) is established to satisfy the equation (1) mentioned above, the restoration of the cleaning roller 21 continues during the movement of the cleaning roller 21 from the restoring initiation point (sucking initiation point) P1 shown in FIG. 4 to the point P2 passing through the ink ejection nozzle. Thus, when the cleaning roller 21 passes through the ink ejection nozzles 16, the increased liquid absorbing force of the cleaning roller 21 is applied to the ink ejection nozzle 16. Accordingly, ink stuck into the ink ejection nozzle or its vicinity so as to thicken is absorbed and removed.

In such a manner, according to the head cartridge 3 of the first embodiment of the present invention, there is provided the projection 17 arranged at a position in the foreground of the ink ejection nozzles 16 in the cleaning direction, so that the absorbing force Qt is produced by the shape restoration operation of the cleaning roller 21 elastically deformed by the pressurizing with the projection 17. Therefore, to the capillarity Qn and the absorption force Qr ordinarily produced along with the rolling of the cleaning roller 21, the above-mentioned absorbing force Qt is added, so that the increased liquid absorbing force improves the cleaning operation with the cleaning roller 21. Thereby, ink stuck into the ink ejection nozzle or its vicinity so as to thicken is efficiently removed.

By maintaining the restoring operation of the elastic deformation of the cleaning roller 21 until the cleaning roller 21 passes through the ink ejection nozzles 16, an absorbing force increased by adding the absorbing force Qt due to the restoration operation can be applied to the ink ejection nozzle 16. Therefore, ink stuck into the ink ejection nozzle or its vicinity so as to thicken is efficiently removed, improving the ejection performance and the quality of printed images.

According to the first embodiment, the cylindrical cleaning roller 21 has been exemplified; alternatively, it may be not cylindrical but prismatic. In this case, although the absorption force Qr produced in the portion where a pressed state is canceled along with the rolling of the cleaning roller 21 does not exist because the cleaning roller 21 does not roll over the nozzle surface 12*a*, the absorbing force Qt produced along with the restoring of the elastic deformation due to the projection 17 is added to the capillarity Qn, so that the increased liquid absorbing force also improves the cleaning operation in the same way as with the cylindrical cleaning roller 21.

Figure 10:
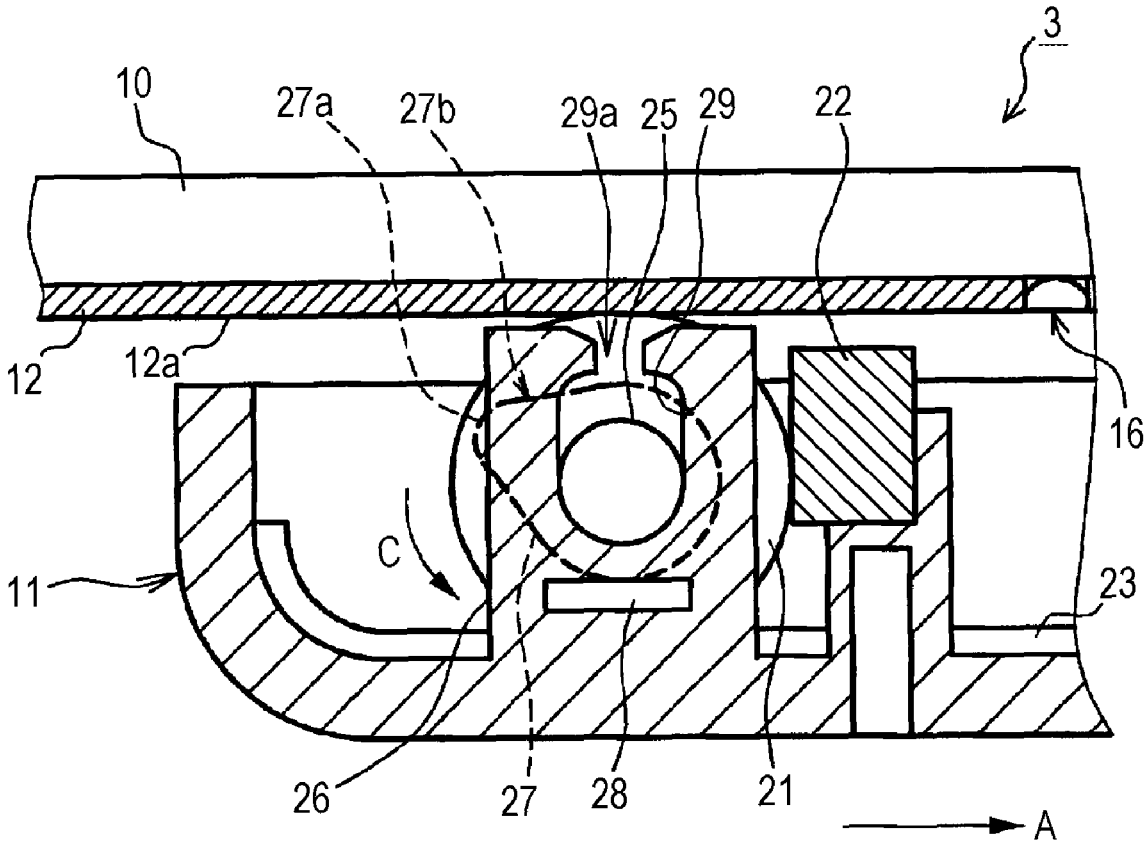
FIG. 10 is an enlarged sectional view of an essential part of a head cartridge according to a second embodiment of the present invention.

FIG. 10 is a sectional side view of the essential part of a head cartridge according to a second embodiment of the present invention. As shown in FIG. 10, the cleaning roller 21 is accommodated adjacent on one side within the head cap 11 provided on the bottom surface of the print head 10 of the head cartridge 3. The cleaning roller 21 is integrally provided with a rotational shaft 25 that is journaled on bearings 26 arranged on the bottom surface of the head cap 11 in its longitudinal direction.

Figure 11:
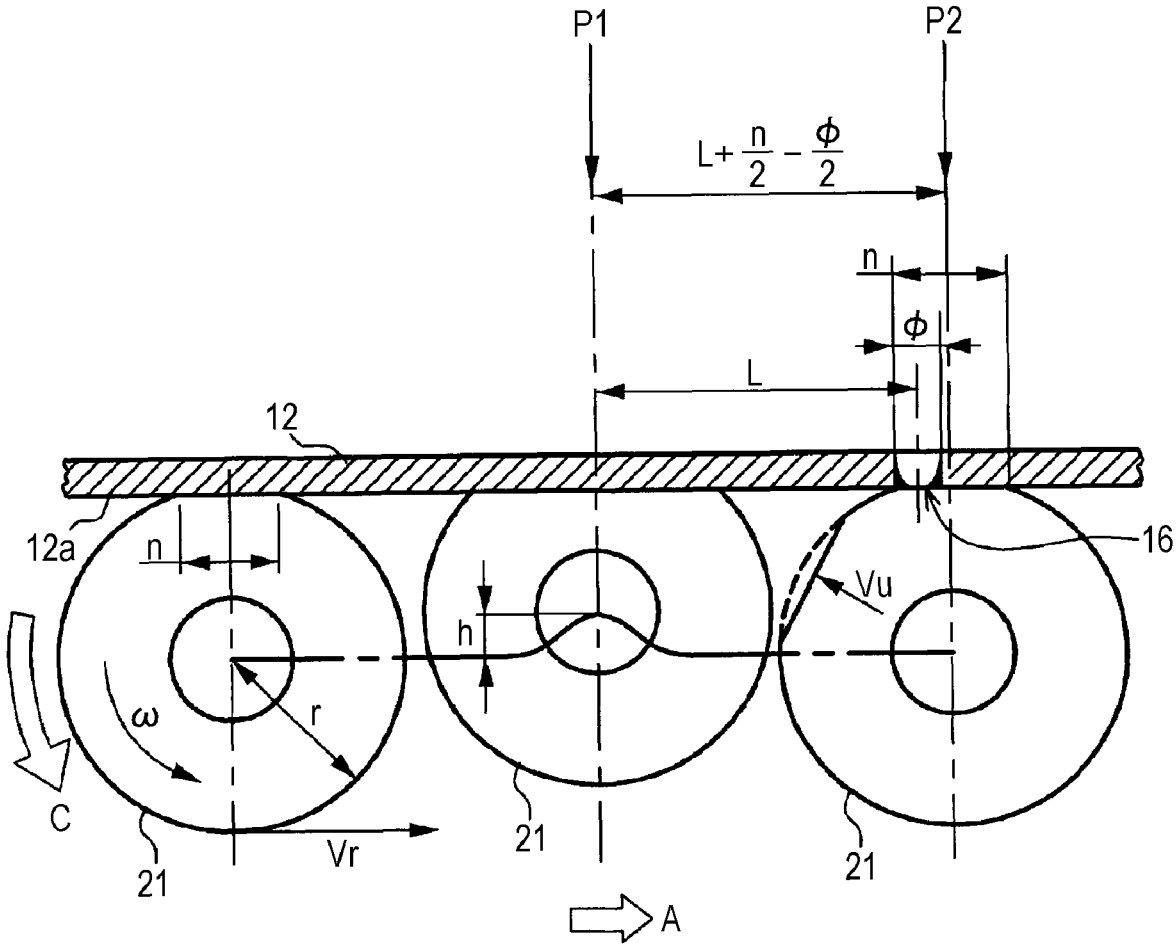
FIG. 11 is an explanatory view illustrating establishment of the height of the apex of an eccentric cam.

Moreover, the rotational shaft 25 is integrally provided with an eccentric cam 27. A half of a slide-contact surface 27*b* of the eccentric cam 27 shown in FIG. 10 is formed to have the same rotational radius while the other half is outward protruded to have different rotational radii. The slide-contact surface 27*b* is brought into contact with the upper surface of a fixed part 28 provided in the bearing 26, so that the eccentric cam 27 is eccentrically rotated on the fixed part 28 so as to elevate the cleaning roller 21 for increasing the elastic displacement of the cleaning roller 21 at a position in the foreground of the ink ejection nozzles 16 in the cleaning direction (arrow A direction of FIG. 10). A maximum elevation h of the cleaning roller 21 (see FIG. 11) is determined so as to apply enough deformation to maintain the restoration of the elastic deformation while the cleaning roller 21 passes through the ink ejection nozzles 16. The maximum elevation h agrees with the projection (height) of an apex 27*a* of the eccentric cam 27 as well as substantially agrees with the elastic displacement (temporarily increased elastic displacement) of the cleaning roller 21 due to the eccentric cam 27. In this case, as shown in FIG. 11, if the point that the cleaning roller 21 is elevated at most denotes the restoring initiation point (sucking initiation point) P1, and other parameters are denoted as the same as those of the first embodiment, the equation (1) mentioned above can be applied as it is. Accordingly, when the maximum elevation h of the cleaning roller 21 is established to satisfy the equation (1), the restoration of the elastic deformation is maintained while the cleaning roller 21 passes through the ink ejection nozzles 16.

Also, as shown in FIG. 10, the bearing 26 is provided with an elliptic bearing hole 29 elongated vertically, so that the rotational shaft 25 of the cleaning roller 21 is vertically movable. The bearing 26 is also provided with a slit 29*a* formed on the upper end of the bearing hole 29, so that the rotational shaft 25 is detachable through the slit 29*a*, enabling the cleaning roller 21 to be replaceable.

Next, the cleaning operation of the head cartridge according to the second embodiment will be described with reference to FIGS. 10 to 13.

During cleaning operation, the head cap 11 is moved in arrow A direction of FIG. 10 in a state that the cleaning roller 21 is pressurized in contact with the nozzle surface 12*a* of the print head 10. Along with this, the cleaning roller 21 is moved in arrow A direction of FIG. 10 while rotating in arrow C direction of the drawing in a state that the rotational shaft 25 is journaled on the bearings 26 provided in the head cap 11. At the first stage of the cleaning operation, the eccentric cam 27 provided integrally with the rotational shaft 25 is rotated in a state that the half of the slide-contact surface 27*b* formed to have the same rotational radius comes in contact with the fixed part 28 of the bearing 26. Accordingly, in this stage, the cleaning roller 21 performs a so-called ordinary cleaning by maintaining a predetermined pressure contact amount to the nozzle surface 12*a*. In this stage, as shown in FIG. 7B, the capillarity Qn in arrow D direction in the drawing is produced in the pressure contact surface between the cleaning roller 21 and the nozzle surface 12*a*. Also, the absorbing force Qr in arrow E direction is produced in the portion in that the pressurizing to the nozzle surface 12*a* is canceled along with the rolling of the cleaning roller 21. Thereby, the sum (Qn+Qr) of the capillarity Qn and the absorption force Qr is applied on the nozzle surface 12*a* so as to absorb and remove the ink 24 adhered on the nozzle surface 12*a* with the cleaning roller 21.

Furthermore, along with the rolling of the cleaning roller 21, the eccentric cam 27 is rotated. When the state that the half of the slide-contact surface 27*b* formed to have the same rotational radius comes in contact with the fixed part 28 is terminated, the rotational radius of the eccentric cam 27 gradually increases. Along with this, the cleaning roller 21 is gradually elevated in arrow I direction of FIG. 12 so as to increase the pressure contact amount to the nozzle surface 12*a*.

Figure 12:
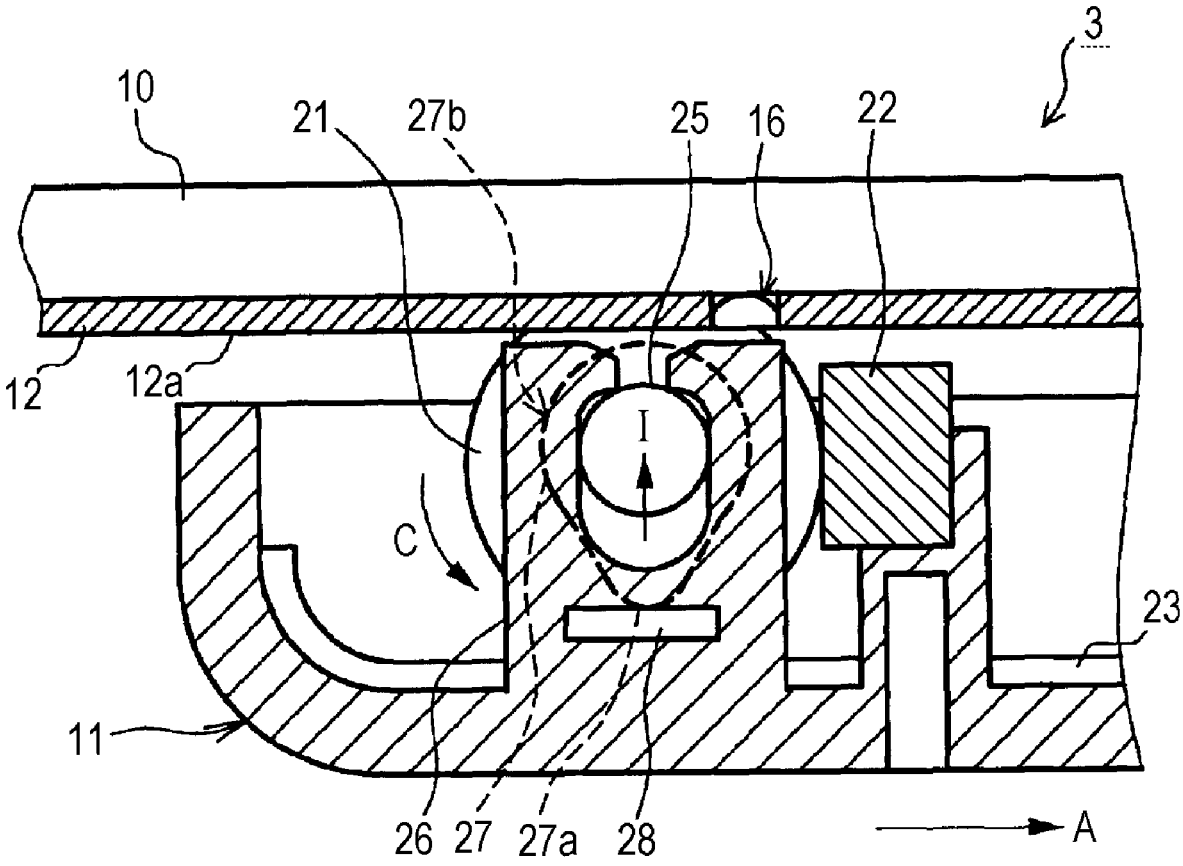
FIG. 12 is an explanatory view showing the cleaning operation of the head cartridge and illustrating a maximum pressure contact state between the cleaning roller and a nozzle surface.

Then, as shown in FIG. 12, when the apex 27*a* of the eccentric cam 27 abuts the fixed part 28, the cleaning roller 21 is elevated at the highest (elevation h). Thereby, the pressure contact amount between the cleaning roller 21 and the nozzle surface 12*a* is maximized, so that the elastic displacement of the cleaning roller 21 is maximized. In this state, the central axis of the cleaning roller 21 agrees with the restoring initiation point (sucking initiation point) P1 shown in FIG. 11.

Then, when from the state of FIG. 12, the head cap 11 is moved in arrow A direction, the cleaning roller 21 passes through the ink ejection nozzles 16 while rolling. Simultaneously, the eccentric cam 27 rotates on the fixed part 28 along with the rolling of the cleaning roller 21, so that the rotational radius of the eccentric cam 27 gradually decreases. Thereby, the cleaning roller 21 gradually descends in arrow J direction of FIG. 13 so that the pressure contact amount between the cleaning roller 21 and the nozzle surface 12*a* is gradually reduced. When along with the rolling of the cleaning roller 21, the eccentric cam 27 is further rotated to be the state of FIG. 13, the pressure contact amount is restored to the ordinary state shown in FIG. 10.

Figure 13:
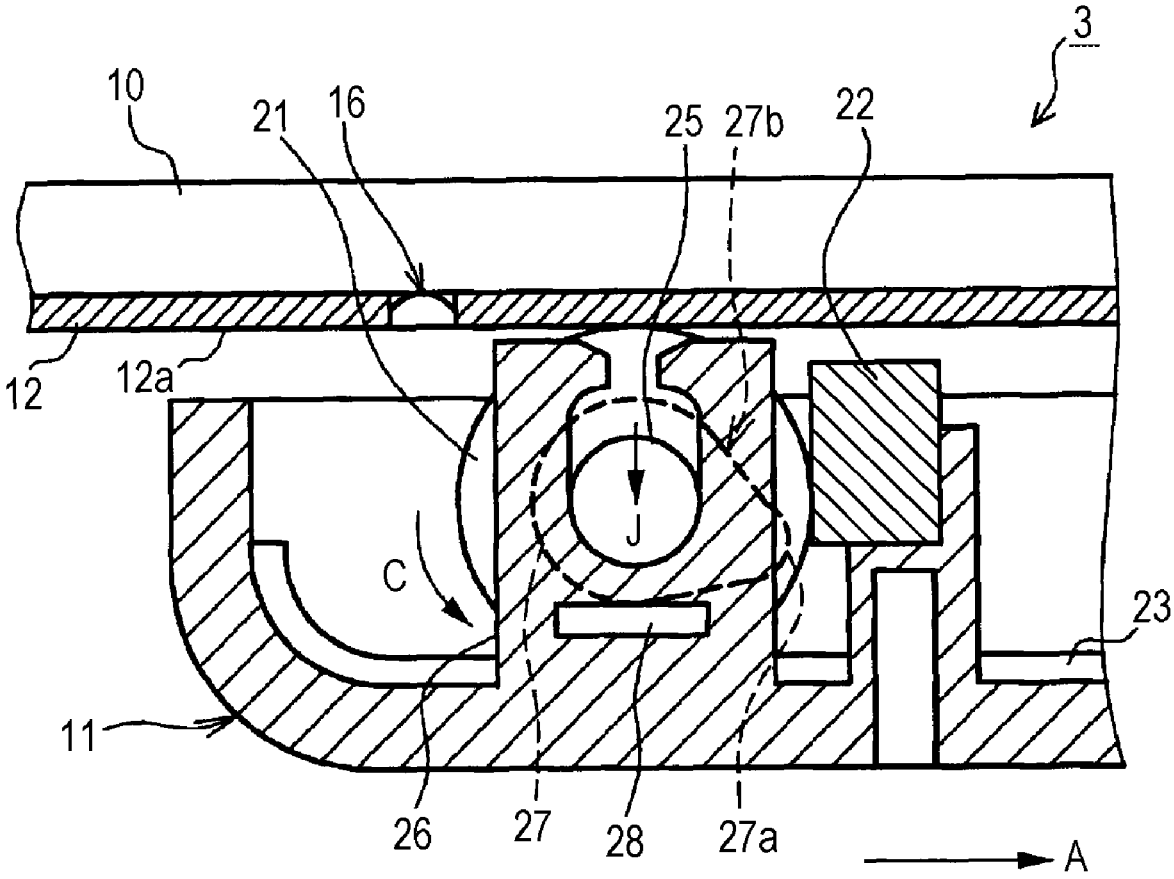
FIG. 13 is an explanatory view showing the restoration to an ordinary pressure contact state in the cleaning operation of the head cartridge.

In such a manner, in a transition stage from the state shown in FIG. 12 to the state shown in FIG. 13, when the pressure contact amount is decreased, the elastic deformation is restored in the pressure contact part. Along with the restoring operation, the absorbing force Qt is produced in the cleaning roller 21. Moreover, since the maximum elevation h of the cleaning roller 21 (or the height of the apex 27*a* of the eccentric cam 27 or the temporarily increased elastic displacement of the cleaning roller 21) is established so as to continue the restoration operation of the elastic deformation of the cleaning roller 21 while the cleaning roller 21 passes through the ink ejection nozzles 16, the restoration operation of the elastic deformation is also maintained during the passing of the cleaning roller 21 through the ink ejection nozzles 16. Hence, the absorbing force produced along with the restoring operation is applied to the ink ejection nozzle 16. Thereby, the sum of the ordinarily produced capillarity Qn and the absorption force Qr, and the absorbing force Qt, the absorbing force (Qn+Qr+Qt), is applied to the ink ejection nozzle 16 and its vicinity, improving the cleaning performance with the cleaning roller 21.

In such a manner, according to the head cartridge of the second embodiment of the present invention, during the cleaning operation, the pressure contact amount is changed by vertically moving the cleaning roller 21, so that the absorbing force Qt is produced when the cleaning roller 21 descends to reduce the pressure contact amount. An absorbing force more increased by adding the absorbing force Qt to the capillarity Qn and the absorption force Qr ordinarily produced along with the rolling of the cleaning roller 21 can be applied to the ink ejection nozzle 16. Accordingly, the cleaning performance with the cleaning roller 21 is improved, thereby effectively removing ink stuck to the nozzle surface 12*a* so as to thicken.

Also, by maintaining the restoring operation of the elastic deformation of the cleaning roller 21 until the cleaning roller 21 passes through the ink ejection nozzles 16, the absorbing force increased by adding the absorbing force Qt produced along with the restoration operation thereto can be applied to the ink ejection nozzle 16. Accordingly, ink stuck into the ink ejection nozzle or its vicinity so as to thicken is efficiently removed, improving the ejection performance and the quality of printed images.

Since the projection does not exist on the nozzle surface 12*a*, the nozzle surface 12*a* can be difficult to be stuck by ink and stain.

In addition, when the head cartridge 3 is for color printing, four apexes 27*a* of the eccentric cam 27 may be provided. In this case, each apex 27*a* is provided so as to maximize the elevation of the cleaning roller 21 at a position in the foreground of each color-ink ejection nozzle 16 in the cleaning direction. Then, while the cleaning roller 21 passes through each color-ink ejection nozzle 16, the height h of each apex 27*a* is established so as to satisfy the equation (1) mentioned above and to maintain the restoring operation of the elastic deformation of the ink ejection nozzle 16.

In the above description, the inkjet printer is exemplified; the present invention is not limited to this, so that any apparatus for ejecting predetermined liquid as liquid droplets from the liquid ejection nozzles may be applied. For example, an image forming apparatus, such as an inkjet facsimile apparatus and an inkjet copying machine, may be incorporated.

The liquid ejected from the liquid ejection nozzles is not limited to ink, so that other liquid ejection apparatuses may be incorporated as long as they form dots or dot lines by ejecting predetermined liquid from a liquid ejection head. For example, a liquid ejection apparatus for ejecting DNA contained liquid on a palette used in the DNA evaluation and a liquid ejection apparatus for ejecting liquid containing conductive particles for forming a wiring pattern of a printed circuit board may be incorporated.

What is claimed is:

1. A head cartridge comprising:

a liquid ejection head configured to eject a predetermined liquid from a plurality of liquid ejection nozzles formed on a nozzle surface;

a cleaning section configured to clean the nozzle surface of the liquid ejection head by relatively moving a porous wiping member so as to bring the wiping member into contact with the nozzle surface with elastic deformation of the wiping member; and a deforming configuration configured to temporarily increase the elastic deformation of the wiping member at a position in the foreground of the liquid ejection nozzles in the cleaning direction, wherein, liquid stuck on the nozzle surface is absorbed and removed by an absorbing force produced along with restoring operation of the elastic deformation of the wiping member.

2. The head cartridge according to claim 1, wherein the deforming configuration comprises a projection of the nozzle surface of the liquid ejection head arranged at a position in the foreground of the liquid ejection nozzles in the cleaning direction.

3. The head cartridge according to claim 1, wherein the deforming configuration comprises an increasing means configured to temporarily increase a pressure contact amount of the wiping member to the nozzle surface at a position in the foreground of the liquid ejection nozzles in the cleaning direction.

4. The head cartridge according to claim 3, wherein the increasing means comprises an eccentric cam provided in a rotational shaft of the wiping member.

5. The head cartridge according to claim 1, wherein the deforming configuration produces deformation enough for maintaining restoring operation of the elastic deformation of the wiping member during passing of the wiping member through the liquid ejection nozzles.

6. The head cartridge according to claim 1, wherein the wiping member is formed in a roller shape, and rolls while elastically deforming due to the pressure contact to the nozzle surface.

7. A liquid ejection apparatus comprising a head cartridge that includes (a) a liquid ejection head configured to eject a predetermined liquid from a plurality of liquid ejection nozzles formed on a nozzle surface; (b) a cleaning section configured to clean the nozzle surface of the liquid ejection head by relatively moving a porous wiping member so as to bring the wiping member into contact with the nozzle surface with elastic deformation of the wiping member; and (c) a deforming configuration configured to temporarily increase the elastic deformation of the wiping member at a position in the foreground of the liquid ejection nozzles in the cleaning direction, wherein, liquid stuck on the nozzle surface is absorbed and removed by an absorbing force produced along with restoring operation of the elastic deformation of the wiping member.

8. The apparatus according to claim 7, wherein the deforming configuration comprises a projection of the nozzle surface of the liquid ejection head arranged at a position in the foreground of the liquid ejection nozzles in the cleaning direction.

9. The apparatus according to claim 7, wherein the deforming configuration comprises an increasing means configured to temporarily increase a pressure contact amount of the wiping member to the nozzle surface at a position in the foreground of the liquid ejection nozzles in the cleaning direction.

10. The apparatus according to claim 9, wherein the increasing means comprises an eccentric cam provided in a rotational shaft of the wiping member.

11. The apparatus according to claim 7, wherein the deforming configuration produces deformation enough for maintaining restoring operation of the elastic deformation of the wiping member during passing of the wiping member through the liquid ejection nozzles.

12. The apparatus according to claim 7, wherein the wiping member is formed in a roller shape, and rolls while being elastically deformed due to the pressure contact to the nozzle surface.

* * * * *